US005571038A

United States Patent [19]

Halling

[11] Patent Number: 5,571,038

[45] Date of Patent: Nov. 5, 1996

[54] MODEL AIRPLANE FLIGHT SIMULATOR

[76] Inventor: Richard Halling, 4113 Prescott St., Sarasota, Fla. 34232

[21] Appl. No.: 515,452

[22] Filed: Aug. 15, 1995

[51] Int. Cl.[6] ..... A63H 27/00

[52] U.S. Cl. ..... 446/232; 434/32

[58] Field of Search ..... 446/230–233, 446/236; 434/32, 55, 37

[56] References Cited

U.S. PATENT DOCUMENTS

| | | | |
|---|---|---|---|
| 1,402,498 | 1/1922 | Horn | 446/232 X |
| 3,398,950 | 8/1968 | Brass et al. | 434/32 X |
| 3,858,347 | 1/1975 | Horn et al. | 446/176 |
| 4,037,358 | 7/1977 | Rosenbaum | 446/30 |
| 4,177,984 | 12/1979 | Douglas et al. | 472/11 |
| 5,334,070 | 8/1994 | Yu et al. | 446/31 |
| 5,344,354 | 9/1994 | Wiley | 446/7 |

*Primary Examiner*—Mickey Yu
*Attorney, Agent, or Firm*—Charles J. Prescott

[57] ABSTRACT

A model airplane flight simulator which enables a model airplane to be maneuvered by a remote control device through pitch, yaw and roll without movement over ground. The model airplane includes most of the attributes of a flying model such as one and preferably two, motor-driven propellers for generating airflow over control surfaces which include actuator controlled ailerons, elevator and rudder and a remote control device for selectively controlling these features from the remote location. The control device may utilize hard wiring or radio signal to activate the actuator system. No airfoil for wing lift is required in that the model airplane is supported within a rigid inner ring or hoop to which wing or fuselage extension rods coaxially extending from each wing tip or from each end of the fuselage are connected at diametrically opposing points on the inner ring for free rotation of the model airplane within the inner ring about one rotational axis. The inner ring is itself supportively connected for free rotation within a rigid outer ring or hoop along another rotational axis orthogonal to that passing through the wing or fuselage extensions. The outer ring, which may also be a half ring, is supportively connected for free rotation to a stationary support or base member about yet another rotational axis orthogonal to and intersecting the second axis at a mid-point between the bearing members connecting the inner and outer rings.

2 Claims, 4 Drawing Sheets

MODEL AIRPLANE FLIGHT SIMULATOR

BACKGROUND OF THE INVENTION

1. Scope of Invention

This invention relates generally to model aircraft flight simulators, and more particularly to such a flight simulator providing all degrees of freedom of controlled movement for the model airplane while in a generally stationary position over ground.

2. Prior Art

Use of model airplanes to simulate flight is certainly well known. One aspect of utilization of simulated model airplane flight is with respect to aircraft design refinement and testing. It is generally well known, for example to position a miniature model airplane in a wind tunnel to observe its flight and air deflection characteristics. A third aspect as of airplane simulation is with respect to simulating realistic control handling of a full size cockpit of a commercial aircraft.

The present invention, however, is associated primarily with model airplane flight simulation as an amusement device and for facilitating practice of model radio control airplane flying using a conventional radio transmitter.

One prior art device known to applicant was invented by Rosenbaum, U.S. Pat. No. 4,037,358, and is directed to a model airplane drive and control system wherein the model is hung from a movable trolley rollably attached to an upper ceiling member. A separate unique hard wired control activates internal components of the model airplane to effect simulated actual aircraft maneuvers.

Another model flight simulator is disclosed in U.S. Pat. No. 4,858,347 invented by Horn, et al. which teaches a stationary suspended model airplane over which air flow is passed. Hard wired actuator mechanisms for the control surfaces provide stationary maneuverability of the model airplane.

Douglas has invented a captive flying toy airplane having simulated motor sounds as disclosed in U.S. Pat. N. 4,177,984. This invention includes a tethered flying toy airplane which flies in circles about a stationary pylon housing and a remote hard wired actuator for controlling speed and altitude of the model airplane.

Another tethered controlled flying toy airplane invented by Yu et al. in U.S. Pat. No. 5,334,070 teaches the use of a flexible rotating cable within a hollow tube for propeller rotation and simulating flight.

An even more remotely associated flight simulating airplane toy is disclosed in U.S. Pat. No. 5,344,354 invented by Wiley. This device consists of two handle control grips resembling a conventional cockpit control yoke.

The present invention teaches a unique frame assembly for supporting a model airplane and for allowing it to move freely in all degrees of freedom, namely pitch, roll and yaw while generally remaining stationary with respect to the ground.

BRIEF SUMMARY OF THE INVENTION

This invention is directed to a model airplane flight simulator which enables a model airplane to be maneuvered by a remote control device through pitch, yaw and roll without movement over ground. The model airplane includes most of the attributes of a flying model such as one and preferably two, motor-driven propellers for generating airflow over control surfaces which include actuator controlled ailerons, elevator and rudder and a remote control device for selectively controlling these features from the remote location. The control device may utilize hard wiring or radio signal to activate the actuator system. No airfoil for wing lift is required in that the model airplane is supported within a rigid inner ring or hoop to which wing or fuselage extension rods coaxially extending from each wing tip or each end of the fuselage are connected at diametrically opposing points on the inner ring for free rotation of the model airplane within the inner ring about one rotational axis. The inner ring is itself supportively connected for free rotation within a rigid outer ring or hoop along another rotational axis orthogonal to that passing through the wings or fuselage extensions. The outer ring, which may also be a half ring, is supportively connected for free rotation to a stationary support or base member about a yet another rotational axis orthogonal to and intersecting the second axis at a mid-point between the bearing members connecting the inner and outer rings.

It is therefore an object of this invention to provide a fully-operable model airplane flight simulator which realistically simulates all degrees of freedom of movement of the model airplane as effected by a remote control device.

It is yet another object of this invention to provide a model airplane flight simulator having a uniquely configured frame assembly which provides for full, realistic movement of the model airplane about three separate orthogonal axes.

It is still another object of this invention to provide a model airplane flight simulator which incorporates rotating propeller means to create air flow over all of the control surfaces for maneuverability.

In accordance with these and other objects which will become apparent hereinafter, the instant invention will now be described with reference to the accompanying drawings.

DETAILED DESCRIPTION OF THE INVENTION

Figure 1:
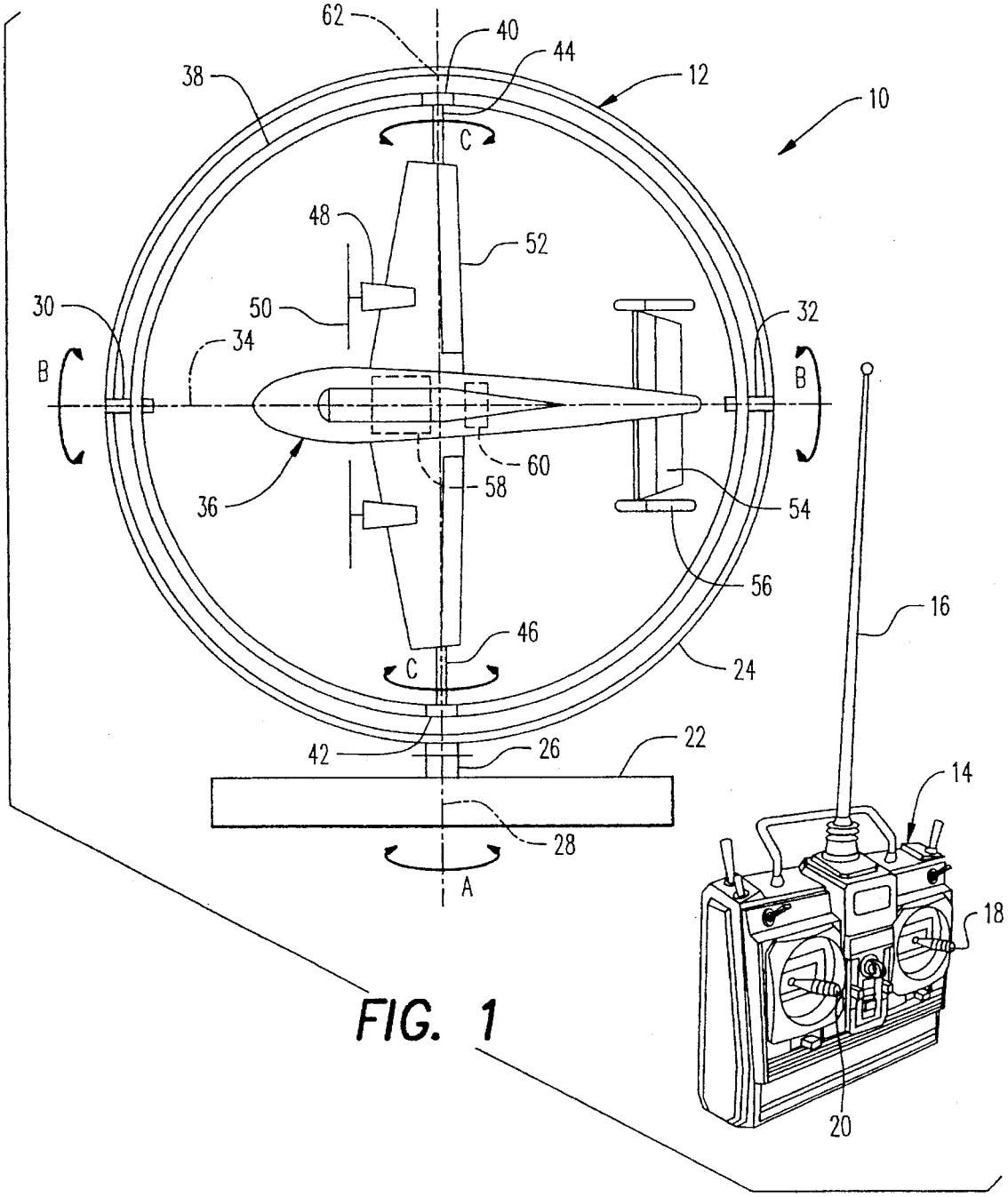
FIG. 1 is a side elevation and perspective view of one embodiment of the invention.
Figure 2:
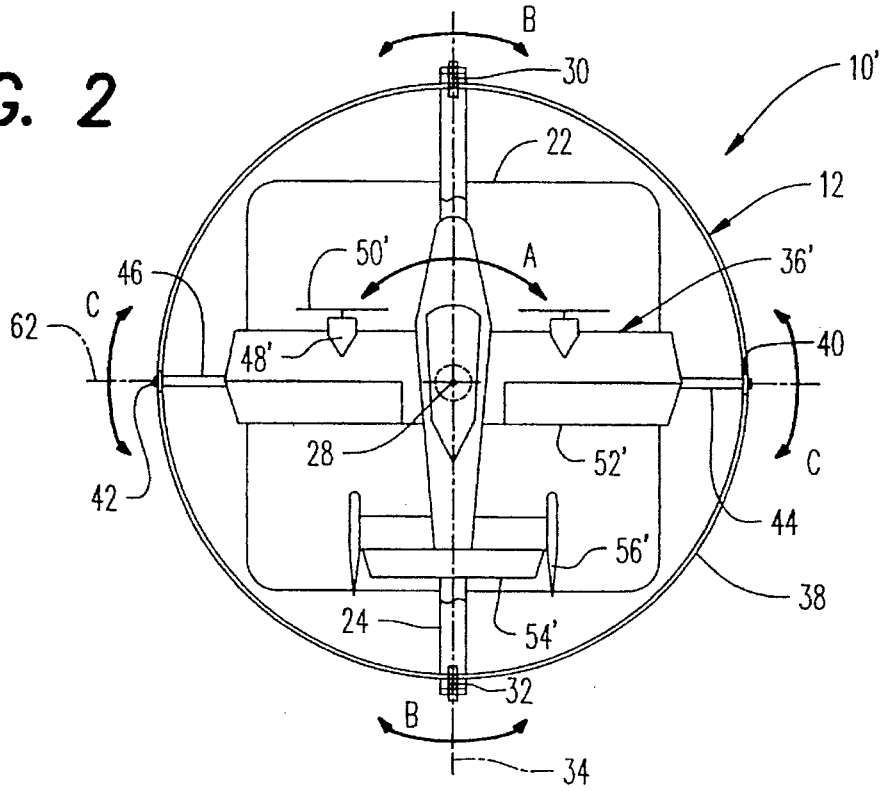
FIG. 2 is a top plan partially broken view of FIG. 1 showing an alternate model airplane configuration.

Referring now to the drawings, and firstly as to FIGS. 1 and 2, two embodiment of the invention are shown generally at numeral 10 and 10'. The primary difference between these two embodiments 10 and 10' is with respect to the configuration of the model airplane 36 or 36'.

Both embodiments 10 and 10' include a frame assembly shown generally at 12 which includes a flat base 22 supportable atop a stationary surface. A rigid outer circular ring or hoop 24 is connected to the base 22 by bearing assembly 26 for free relative rotation therebetween about upright rotational axis 28 in the direction of arrow A. A rigid inner circular ring or hoop 38 is fitted within the outer ring 24 and mounted by bearings 30 and 32 for free relative rotation between the inner and outer rings 38 and 24, respectively about a second rotational axis 34 in the direction of arrow B. Rotational axis 34 is orthogonal to, and intersects rotational axis 28 and is parallel to the support surface.

Each of the model airplanes 36 or 36' is connected by rigid tubular wing extensions 44 and 46 to opposing bearings 40 and 42 at diametrically opposed points on inner ring 38. These tubular wing extensions 44 and 46 extend into the wing a distance sufficient for secure support therebetween. By this arrangement, the model airplane 36 or 36' is freely rotatable about a third rotational axis 62 in the direction of arrows C.

The frame assembly 12 thus provides concentric inner and outer circular rings 38 and 24, respectively which are freely rotatable with respect to one another about the second rotational axis 34 in the direction of the arrows B. The third rotational axis 62 passes generally through the wings and fuselage of each airplane 36 or 36' and is orthogonally oriented and intersects the second rotational axis 34. Again, the first rotational axis 28 which orthogonally extends from a flat support surface upon which base member 22 is supported, is orthogonal with respect to the second rotational axis 34 and intersects same.

The model airplanes 36 and 36' include an actuator module 58 and on-board battery 60 which initially receive radio control signals emanating from antenna 16 of remote control radio 14 of FIG. 1. These control signals are selectively produced and emanate from antenna 16 by the controlled movement of toggles 18 and 20 in a well known manner. The actuator module 58 receives these transmitted radio signals and independently activates pivotal movement of the ailerons 52 or 52', the elevator 54 or 54' and the upright rudder 56 or 56' as desired by the user.

Because the flight simulator 10 is stationary, air movement to act upon the control surfaces as they are pivotally displaced on a selective basis through activation of toggles 18 and 20 of radio 14 is required. This required airflow is provided by propellers 50 or 50' rotationally driven by supporting motors 48 or 48'. Because the ailerons 52 and 52' are located toward the outboard portions of the wings, two separate motors 48 and 48' and associated rotating propellers 50 and 50' are preferred. However, a single large rotating propeller (not shown) positioned at the forwardly tip of the fuselage will also perform acceptably within the scope of this invention.

By this arrangement, the model aircraft 36 or 36' is moveable by appropriate control surface deflection by about three separate degrees of freedom or axes of rotation 28, 34 and 62 in the direction of arrows A, B and C, respectively. This complete versatility of movement within a stationary frame thus allows the user to practice full maneuvers of rolling, pitching and yawing of the model airplane on a controlled basis and to simply otherwise have fun with this invention.

Figure 3:
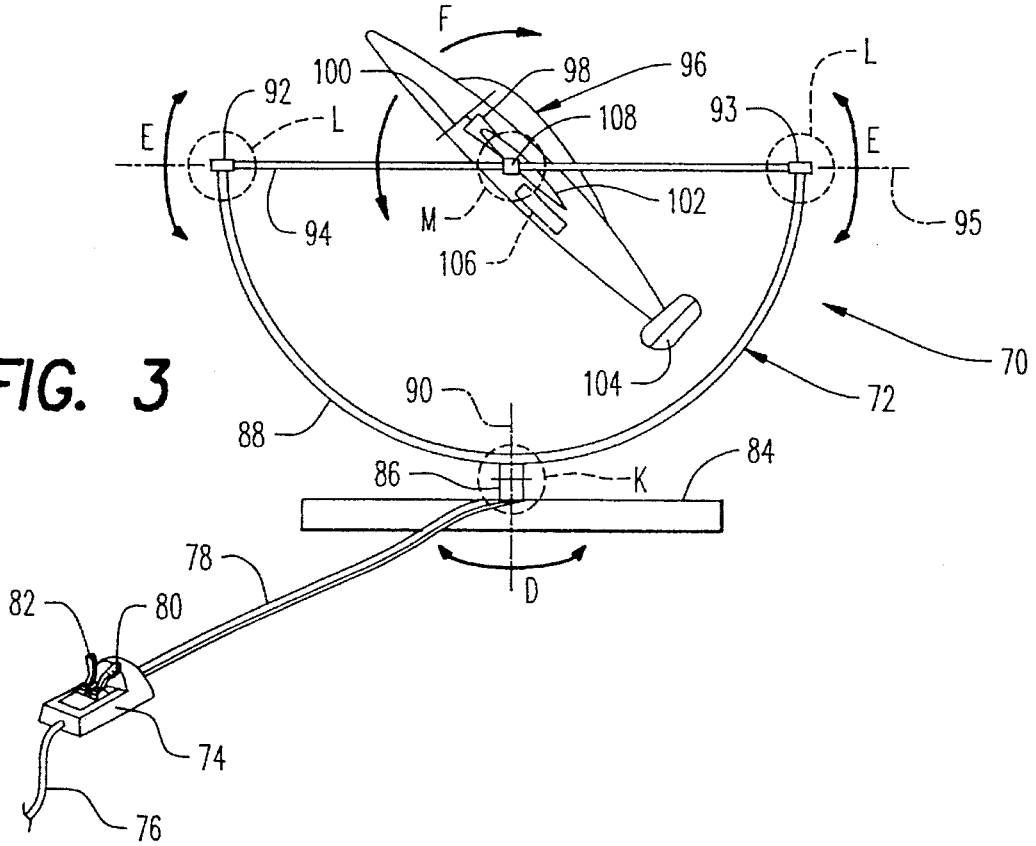
FIG. 3 is a side elevation and perspective view of another embodiment of the invention.

A third embodiment of the invention is shown in FIG. 3, generally at numeral 70. This embodiment 10 also includes a stationary base 84 supportable on a stationary surface. A semi-circular outer ring or half hoop 88 formed of hollow, rigid material of the frame assembly 72 is supported by bearing assembly 86 to facilitate free rotation of the half hoop 88 about an upright rotational axis 90 in the direction of arrow D.

An inner circular ring 94 formed of rigidly hollow material is mounted concentrically with outer half ring 88 for free rotation between the ends of outer half ring 88 at bearings 92 and 94 which are positioned at diametrically opposing positions of inner ring 94. This allows the inner ring 94 to fully rotate in the direction of arrow E about the second rotational axis 95 which is parallel to the support surface atop which base member 84 is placed and generally spaced parallel from that support surface.

Figure 6:
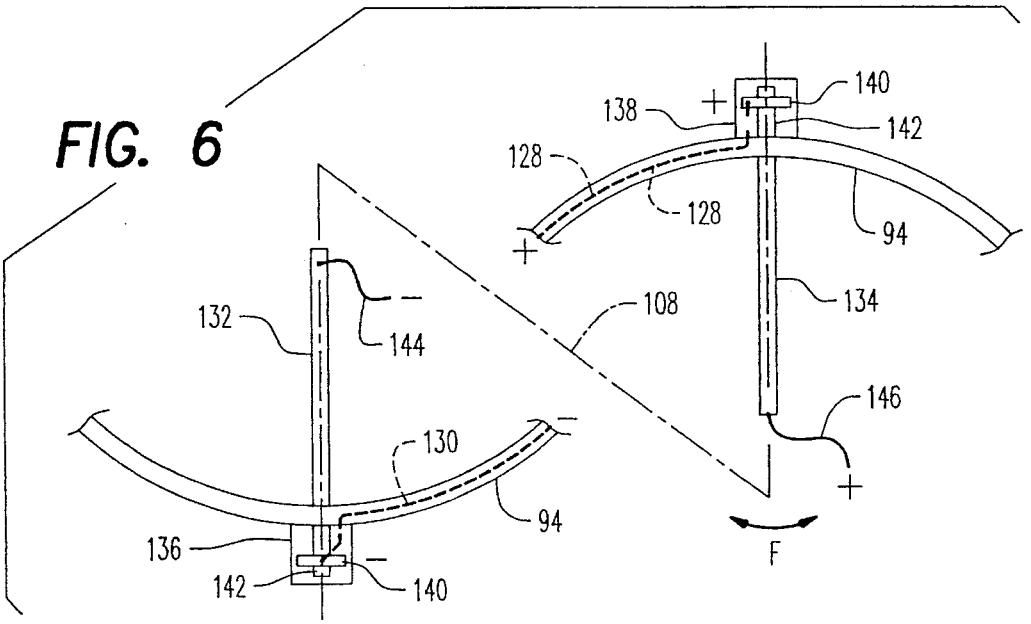
FIG. 6 is a top plan view of areas M of FIG. 3.

The model airplane 96 is again mounted on tubular wing extensions 132 and 134 in FIG. 6 for free rotation about axis 108 which passes through the fuselage and the length of the wings of the model airplane 96. The model airplane 96 is thus freely rotatable in the direction of arrow F about this third rotational axis 108.

Figure 4:
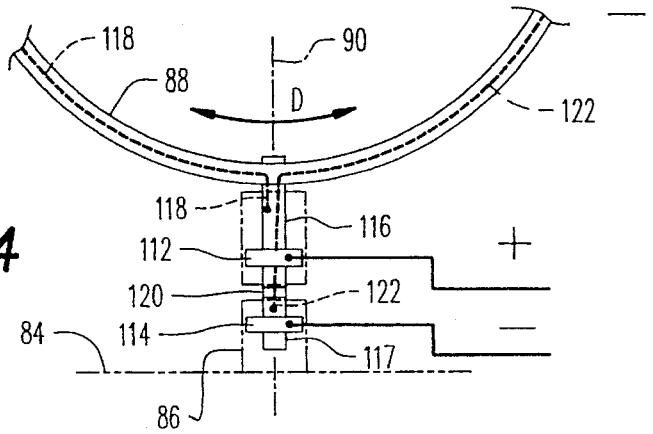
FIG. 4 is an enlarged view of area K of FIG. 3.
Figure 5:
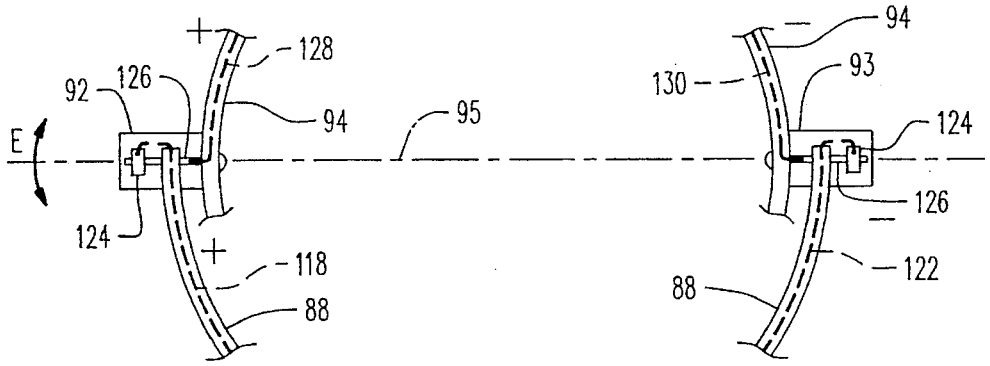
FIG. 5 is an enlarged view of areas L of FIG. 3.

The model airplane 96 includes control surface actuator module 106 which is responsive through a hard wiring arrangement described herebelow in FIGS. 4, 5 and 6 to a control signal produced by hand actuator 74. Connected by hard wiring within protective tube 78, the hand actuator 74 includes toggles 80 and 82 which control the appropriate control surfaces and propeller 100 speed by activation of motor 98 in a fashion similar to that of the radio transmitter 14 in FIG. 1.

Because this embodiment 70 includes a hand actuator 74 which connected to a separate power supplied through wiring 76, no stored battery power is required within the fuselage of the model airplane 96 and thus this embodiment 70 may be operated continuously for as long as the user wishes to do so.

The hard wiring arrangement of the embodiment 70 of FIG. 3 which facilitates free rotation about the three orthogonally oriented rotational axes 90, 95 and 108 as previously described is facilitated by the relative rotational components shown in FIGS. 4, 5 and 6 described herebelow.

In FIG. 4, the enlarged area K of FIG. 3 is there shown. The bearing assembly 86 (shown in phantom) includes a lower bearing 114 and an upper bearing 112 each shaft mounted on 116 and 117 and electrically separated by isolator 120. The positive (+) lead from the hand actuator 74 is electrically connected to bearing 112 while the negative (–) lead from control actuator 74 is connected to bearing 114. A flexible wire 122 extends from, and is in electrical contact with, bearing shaft 117 while flexible wire 118 extends from, and is in electrical contact with, shaft 116. These flexible wires 118 and 122 extend in either direction within a hollow interior of semi-circular ring 88. By the arrangement of FIG. 4, then, the semi-circular ring 88 is freely rotatable about the first rotational axis 90 in the direction of arrow D while maintaining electrical contact between the negative (–) and positive (+) inputs of the two flexible wires 118 and 122, respectively.

In FIG. 5, the enlarged areas L of FIG. 3 are there shown. The flexible wires 118 and 122 extend within the hollow semi-circular ring 88 up to contact stationary bearing 124 (typ.) within bearing assemblies 92 and 93. A conducting shaft 126 (typ.) makes continuing electrical contact with flexible wires 128 and 130. By the arrangement in FIG. 5, then, the hollow circular inner ring 94 of FIG. 3 is freely rotatable about the second rotational axis 95 in the direction of arrows E while maintaining full electrical contact between wiring 118 to 128 and 122 to 130.

In FIG. 6, the enlarged areas M of FIG. 3 are shown in top plan view at each end of the wing of model airplane 96. The rigid inner hollow ring 94 carries the wires 128 and 130 to bearings 136 and 138, respectively. The stationary bearings 140 are in contact with the ends of wires 128 and 130 are connected to transmit electrical signals to rotating bearing shafts 142 and then into conductive wing extensions 132 and 134. Flexible wires 144 and 146 connected to the inner ends of wing extensions 132 and 134, respectively, then carry the appropriate control signal into the actuator module 106.

Two important aspects of the present invention of a general nature need to be described additionally. Although the configuration of the inner and outer frame members are as thus shown in either circular form with respect to the inner frame member and either circular or semi-circular with respect to the outer frame member, nonetheless alternate configurations such as inner and outer rectangular, oval, and square frames and the like will work equally well within the scope of this invention.

Moreover, although the preferred embodiment shown is disposed atop a horizontal stationary surface for support, the invention will work equally well if the base member were attached, for example, to a vertical wall or attached or suspended by a wire or the like from an upper horizontal ceiling member.

Figure 7:
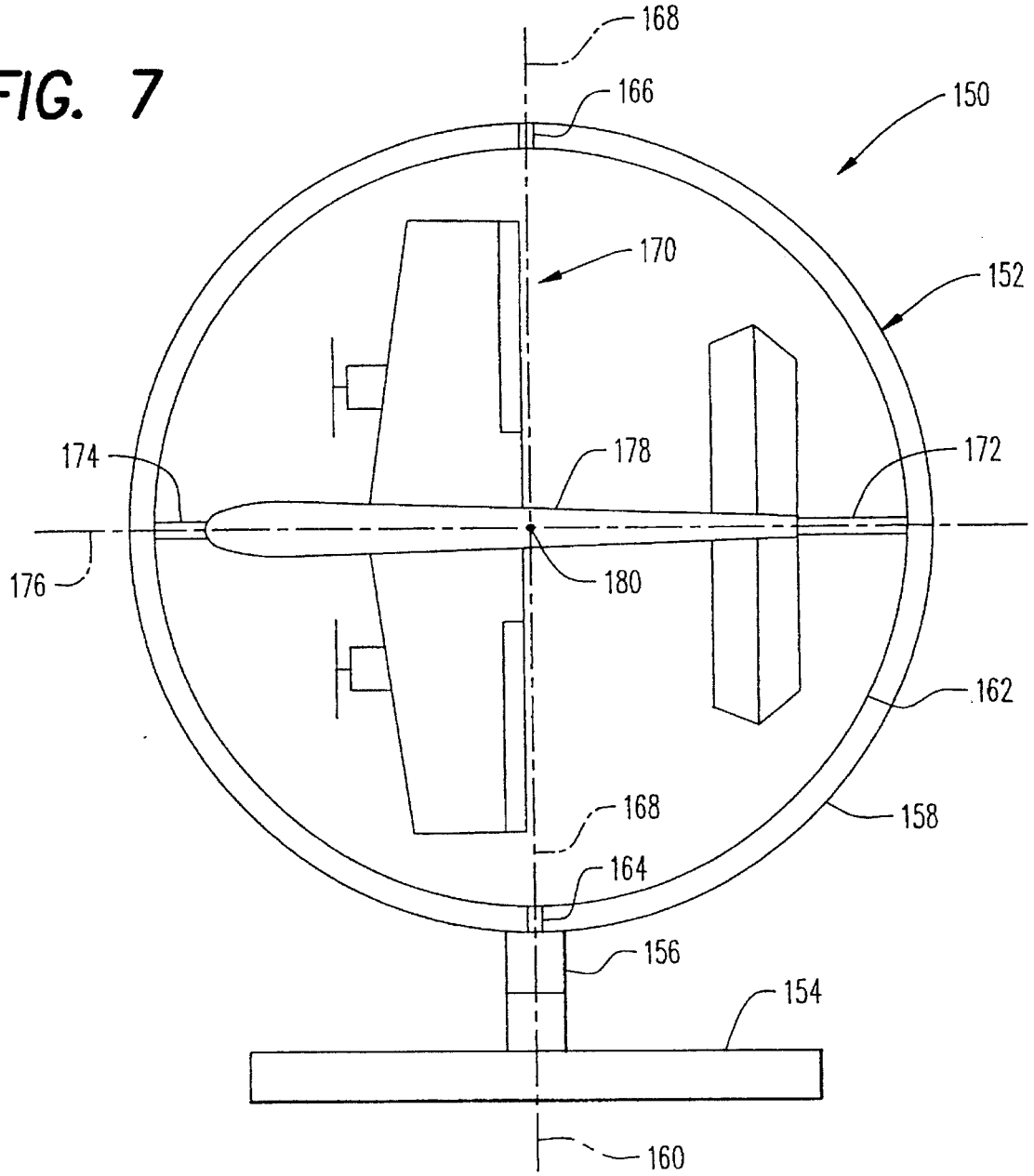
FIG. 7 is a side elevation schematic view of yet another embodiment of the invention.

Referring lastly to FIG. 7, another embodiment of the invention is there shown in schematic at numeral 150. This embodiment 150 includes a frame assembly 152 rotationally supported on a flat base 154 itself supportable against a stationary surface such as a floor, wall or ceiling. An outer rigid circular ring or hoop 158 of the frame assembly 152 is connected to the base by bearing assembly 156 for full relative rotation therebetween about an upright rotational axis 160. A rigid inner circular ring or hoop 162 is fitted within the outer ring 158 and mounted by coaxial bearings 164 and 166 for free relative rotation between the inner and outer rings 162 and 158, respectively, about a second rotational axis 176.

A model airplane 170 similar to those previously described having an elongated fuselage 178, movable control surfaces and operable propellers again as previously described, is mounted on tubular coaxial fuselage extensions 172 and 174 for free relative rotation of the airplane 170 about axis 176 which passes through the length of the fuselage 178. When the model airplane 170 is rotatably positioned about axis 176 so that the wings of the aircraft are generally parallel to base 154, all of the rotational axes 160, 168, and 176 are orthogonal one to another and intersect one another at an imaginary mid point 180 within the fuselage 178.

Because the only input for rotation about any of the respective orthogonal axes of all of the embodiments of the invention results from air deflecting against one or more of the control surfaces when angularly positioned from neutral, the inertia of the inner and outer rings or arcuate frame members should be kept to a minimum by fabrication of extremely thin wall material to minimize inertia about the respective rotational axis. Likewise, the bearings chosen for points of rotation of the invention should be of a high quality with extremely low friction characteristics. When inertia and bearing friction are minimized, this system performs at a maximum level of maneuverability.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A miniature model airplane flight simulator consisting essentially of:

a fuselage;

full wings extending laterally in either direction from a central portion of said fuselage;

an aileron forming a trailing edge portion of each of said wings;

an elevator and a rudder connected to a rear of said fuselage;

actuator means within said fuselage for receiving a remote control signal and for selectively, independently pivotally moving said ailerons, elevator and rudder in response to said remote control signal;

propeller means for producing a flow of air over said ailerons, elevator and rudder to induce full roll, pitch and yaw movement, respectively of said airplane in response to corresponding pivotal movement of said ailerons, elevator and rudder;

first means for supporting said model airplane for free independent rotation of said model airplane about a third rotational axis passing generally through a length of said fuselage;

second means for supporting said first means for free independent rotation of said miniature model airplane about a second rotational axis orthogonally intersecting said third rotational axis and transverse to said fuselage and passing through a central point of said fuselage;

third means for supporting said second means for free independent rotation of said miniature model airplane about a first rotational axis orthogonally intersecting said second rotational axis, said third means also for receiving support for said flight simulator from a stationary surface;

hand-activated means for producing and for conveying said remote control signal to said actuator means;

said first, second and third support means each also for conveying electric dower to said propeller means from a remote source of electric power.

2. A miniature model airplane flight simulator as set forth in claim 1, wherein:

said hand-activated means is a transmitter and said remote control signal is a modulated radio wave.

* * * * *